US006352078B1

(12) United States Patent
Harvey et al.

(10) Patent No.: US 6,352,078 B1
(45) Date of Patent: Mar. 5, 2002

(54) HYPERBARIC CHAMBER ACCESSORIES

(76) Inventors: David E. Harvey; Charles Wright, both of 13760 Gramercy Pl., Gardena, CA (US) 90249

( * ) Notice: Subject to any disclaimer, the term of this patent is extended or adjusted under 35 U.S.C. 154(b) by 0 days.

(21) Appl. No.: 09/399,078

(22) Filed: Sep. 18, 1999

(51) Int. Cl.[7] ..... A61G 10/00

(52) U.S. Cl. ..... 128/205.26; 128/200.24; 454/70

(58) Field of Search ..... 128/202.12, 202.13, 128/202.14, 202.15, 202.16, 202.19, 205.26; 454/70

(56) References Cited

U.S. PATENT DOCUMENTS

| | | | | | |
|---|---|---|---|---|---|
| 2,448,546 | A | * | 9/1948 | Plemel et al. | 128/205.26 |
| 4,467,798 | A | * | 8/1984 | Saxon et al. | 128/205.26 |
| 5,327,904 | A | * | 7/1994 | Hannum | 128/205.26 |
| 5,398,678 | A | * | 3/1995 | Gamow | 128/202.12 |
| 5,685,293 | A | * | 11/1997 | Watt | 128/202.12 |
| 5,799,652 | A | * | 9/1998 | Kotliar | 128/202.12 |
| 5,868,355 | A | * | 2/1999 | Carter | 244/129.5 |

* cited by examiner

*Primary Examiner*—Glenn K. Dawson

(74) *Attorney, Agent, or Firm*—David A. Belasco; Beehler & Pavitt

(57) ABSTRACT

A closure mechanism and seating controls in combination with use with a hyperbaric chamber are described. The closure mechanism in combination with a hyperbaric chamber includes a door opening, a chamber door with dimensions larger than the door opening, a ring of sealing material secured to either the outer surface of the door or the inner surface of the chamber, a means for positioning the door adjacent the door opening and a means for pressurizing the chamber to effect a seal. The closure mechanism also includes an upper rail and pivoting carriers that may slide along the rail and a lower track mounted adjacent the floor and door guides that may slide within the track. The carriers and door guides are mounted to the interior surface of the door. The door and chamber walls may be flat, or curved in one or more planes. A locking mechanism is provided that employs a sliding wedge-shaped member that engages a retaining bar to secure the door in a closed position and a stop for securing the door in an open position. The seating controls in combination with a hyperbaric chamber provide means to swivel a seat support bracket about a base secured to the chamber floor and means rotate a seat about the bracket so that a patient can be easily and comfortably positioned within the chamber. Means are provided to lock the seat in a variety of positions including inclining the seat back.

12 Claims, 10 Drawing Sheets

HYPERBARIC CHAMBER ACCESSORIES

FIELD OF INVENTION

The invention pertains to accessories in combination with pressure vessels. More particularly, the invention relates to closure mechanisms and seating controls in combination with a hyperbaric chamber.

BACKGROUND OF THE INVENTION

Various types of closure mechanisms have been developed in combination with hyperbaric chambers; incorporating a number of different technologies. U.S. Pat. No. 5,327,904 issued to Hannum employs a transparent rectangular door sliding on a pair of rods to seal the chamber. Hannum also discloses a sliding seat arrangement that incorporates a pair of rails to permit the seat to slide forward and back within the chamber.

U.S. Pat. No. 5,398,678 issued to Gamow, incorporates an airtight zipper attached to an inflatable hyperbaric chamber to provide ingress and egress for the chamber. U.S. Pat. No. 4,573,286, issued to Farvel et al. discloses a device for suspending and guiding a movable panel. This invention incorporates a tubular channel with a ball-bearing mounted spherical roller positioned inside of the channel from which the panel is suspended. U.S. Pat. No. 5,433,334 issued to Reneau employs an outwardly hinged door with rotary locking mechanism to secure the opening of a hyperbaric chamber. U.S. Pat. No. 5,857,739 issued to Smith describes a swivel-recliner chair providing a variety of adjustment mechanisms.

While other variations exist, the above-described designs for closure and seating controls in combination with hyperbaric chambers are typical of those encountered in the prior art. It is an objective of the present invention to provide a reliable means for sealing a hyperbaric chamber opening. It is a further objective to provide a closing mechanism that is simple to operate and that provides for easy entrance and egress from the hyperbaric chamber. It is a further objective of the invention to provide a closing mechanism that may be easily manufactured, at a reasonable cost and with the required precision. It is yet a further objective that the closing mechanism be easily adjustable for wear at the sealing surfaces. It is still another objective of the invention to provide a seat control mechanism that allows for convenient and precise positioning of the patient within the chamber. It is yet another objective to provide a seat control that may be easily locked and unlocked in a variety of positions.

While some of the objectives of the present invention are disclosed in the prior art, none of the inventions found include all of the requirements identified.

SUMMARY OF THE INVENTION

The present invention addresses all of the deficiencies of prior art closure and seating control inventions in combination with hyperbaric chambers and satisfies all of the objectives described above.

A closure mechanism in combination with a hyperbaric chamber providing the desired features may be constructed from the following components. A floor, a ceiling, a surrounding wall sealably joined to said floor and said ceiling an inner surface, an outer surface and a door opening having first predetermined dimensions. A ring of malleable sealing material is provided. The sealing material is located on the inner surface of the chamber at a first predetermined distance from the door opening. A means is provided for affixing the sealing material to the inner surface of the chamber.

A hyperbaric chamber door is provided. The door has an inner surface, an outer surface, an upper end and a lower end. The door has second predetermined dimensions that are larger than the first dimensions such that the perimeter of the door extends beyond the ring of the sealing material. Means are provided for positioning the door within the chamber in a first position such that the outer surface of the door abuts the sealing material and in a second position permitting entry into the chamber. Means are provided for pressurizing the chamber.

When the door is located in the first position and the chamber is pressurized, the door will be urged against the sealing material. This action will seal the outer surface of the chamber door to the inner surface of the chamber and permit the pressure within the chamber to be increased above ambient.

In a variant of the invention, the door opening of the hyperbaric chamber is curved in at least one plane and the chamber door is curved in at least one plane such that the door may be sealed in position adjacent the door opening.

In another variant, the hyperbaric chamber door has an inner surface, an outer surface, an upper end and a lower end and has second predetermined dimensions. The second dimensions are larger than the first dimensions such that the perimeter of the door extends beyond the chamber door opening.

A ring of malleable sealing material is provided. The sealing material is located on the outer surface of the chamber door at a second predetermined distance from the door perimeter. A means is provided for affixing the sealing material to the outer surface of the door. Means are provided for positioning the door within the chamber in a first position such that the sealing material abuts the inner surface of the chamber and in a second position permitting entry into the chamber. Means are provided for pressurizing the chamber.

When the door is located in the first position and the chamber is pressurized, the door and the affixed sealing material will be urged against the inner surface of the chamber. This action will seal the outer surface of the chamber door to the inner surface of the chamber and permit the pressure within the chamber to be increased above ambient.

In a variant on this embodiment, the door opening of the hyperbaric chamber is curved in at least one plane and the chamber door is curved in at least one plane such that the door may be sealably positioned adjacent the door opening.

In yet another variant of the invention, means for locking and unlocking the chamber door are provided that include the following components. At least one locking shaft is provided. The shaft has a first end, a second end, a wedge-shaped portion located at the first end and a connecting means located adjacent the second end. The locking shaft is slidably mounted to the inner surface of the chamber door. Means attached to the connecting means of the locking shaft for moving the locking shaft from a first, retracted position to a second extended position are provided. A retaining bar is provided that is mounted to the inner surface of the chamber and located so as to engage the wedge-shaped portion of the locking shaft when the shaft is in the second, extended position and located so as to be disengaged from the wedge-shaped portion when the shaft is in the first, retracted position.

When the chamber door is moved to the first position adjacent the door opening and the locking shaft is moved is moved from the first position to the second position, the wedge-shaped portion will bear against the retaining bar. This action urges the door against the inner surface of the chamber and compresses the ring of sealing material to form an airtight seal between the door and the chamber.

When the pressure is reduced in the chamber and the locking shaft is moved from the second position to the first position, this action disengages the wedge-shaped portion from the retaining bar. The chamber door may now be moved to the second position to permit entry and exit from the chamber.

In still another variant, the means for affixing the sealing material to the inner surface of the chamber includes a groove. The groove is sized and shaped to accept a first, inner portion of the ring of malleable sealing material and located on the inner surface of the hyperbaric chamber at the first predetermined distance from the door opening. Means for attaching the ring of malleable sealing material to the groove are provided.

In yet another variant of the invention, the means for affixing the sealing material to the outer surface of the chamber door includes a groove. The groove is sized and shaped to accept a second, outer portion of the ring of malleable sealing material and located on the outer surface of the chamber door at the second predetermined distance from the door perimeter. Means are provided for attaching the ring of malleable sealing material to the groove.

In still a further variant, the means for positioning the door within the chamber in a first position such that the outer surface of the door abuts the sealing material and in a second position permitting entry into the chamber further includes an L-shaped lower track. The lower track has a first section and a second section. Each of the sections has a first end and a second end and is located adjacent the floor of the chamber. The first section is substantially parallel to the door opening and the second section extends away from the door opening and into the chamber.

First and second lower door guides are provided. The lower guides are affixed to the inner surface of the chamber door adjacent its lower end and are sized, shaped, and located to fit slidably within the lower track. First and second upper carrier rails are provided. Each of the rails has a first end and a second end. The first rail is fixedly attached at its first and second ends to the ceiling of the chamber. The first rail is substantially parallel to door opening and the first section of the lower track. The second rail is fixedly attached at its first and second ends to the ceiling of the chamber. The second rail extends from the second end of the first rail away from the door opening and into the chamber. The second rail is substantially parallel to the second section of the lower track.

A first door carrier is provided. The first carrier is rotatably mounted to the inner surface of the chamber door adjacent its upper end. The first carrier is sized, shaped, and located to move slidably along the first rail. A second door carrier is provided. The second carrier is rotatably mounted to the inner surface of the chamber door adjacent its upper end and is sized, shaped, and located to move slidably along the second rail.

When the chamber door is located in the first position, the first door guide will be located adjacent the first end of the first section of the lower track and the second door guide will be located adjacent the second end of the first section of the lower track. The first door carrier will be located adjacent the first end of the first upper carrier rail and the second door carrier will be located adjacent the first end of the second upper carrier rail. When the carriers and guides are so positioned, it allows the chamber door to be sealed to the chamber.

When the chamber door is located in the second position, the first door guide will be located adjacent the second end of the first section of the lower track and the second door guide will be located adjacent the first end of the second section of the lower track. The first door carrier will be located adjacent the second end of the first upper carrier rail and the second door carrier will be located adjacent the second end of the second upper carrier rail. When the carriers and guides are so positioned, entry into the chamber is possible.

In yet a further variant of the invention, the means for positioning the door within the chamber in a first position such that the sealing material abuts the inner surface of the chamber and in a second position permitting entry into the chamber further includes an L-shaped lower track. The lower track has a first section and a second section. Each of the sections has a first end and a second end and is located adjacent the floor of the chamber. The first section is substantially parallel to the door opening and the second section extends away from the door opening and into the chamber.

First and second lower door guides are provided. The lower guides are affixed to the inner surface of the chamber door adjacent its lower end and are sized, shaped, and located to fit slidably within the lower track. First and second upper carrier rails are provided. Each of the rails has a first end and a second end. The first rail is fixedly attached at its first and second ends to the ceiling of the chamber. The first rail is substantially parallel to door opening and the first section of the lower track. The second rail is fixedly attached at its first and second ends to the ceiling of the chamber. The second rail extends from the second end of the first rail away from the door opening and into the chamber. The second rail is substantially parallel to the second section of the lower track.

A first door carrier is provided. The first carrier is rotatably mounted to the inner surface of the chamber door adjacent its upper end. The first carrier is sized, shaped, and located to move slidably along the first rail. A second door carrier is provided. The second carrier is rotatably mounted to the inner surface of the chamber door adjacent its upper end and is sized, shaped, and located to move slidably along the second rail.

When the chamber door is located in the first position, the first door guide will be located adjacent the first end of the first section of the lower track and the second door guide will be located adjacent the second end of the first section of the lower track. The first door carrier will be located adjacent the first end of the first upper carrier rail and the second door carrier will be located adjacent the first end of the second upper carrier rail. When the carriers and guides are so positioned, it allows the chamber door to be sealed to the chamber.

When the chamber door is located in the second position, the first door guide will be located adjacent the second end of the first section of the lower track and the second door guide will be located adjacent the first end of the second section of the lower track. The first door carrier will be located adjacent the second end of the first upper carrier rail and the second door carrier will be located adjacent the second end of the second upper carrier rail. When the carriers and guides are so positioned, entry into the chamber is possible.

In another variant of the invention, a seat pivoting system in combination with a hyperbaric chamber includes the following components. A hyperbaric chamber is provided. The chamber has a floor, a ceiling, a surrounding wall sealably joined to said floor and said ceiling an inner surface, an outer surface and a door opening having first predetermined dimensions. A base is provided that is fixedly attached to the chamber floor adjacent the door opening.

A seat support bracket is provided. The bracket has a first end and a second end and is rotatably mounted at the first end to the base. Means are provided for controlling the rotation of the bracket about the base. A seat-mounting platform is provided. The platform is rotatably mounted to the second end of the bracket. Means are provided for controlling the rotation of the platform about the bracket. A lower seat portion is fixedly attached to the seat-mounting platform. A seat back portion is pivotally mounted to the lower seat portion. Means are provided for adjusting the inclination of the seat back portion with respect to the lower seat portion. In use, the means for controlling the rotation of the bracket about the base is loosened so that the bracket may pivot about the base. The means for controlling the rotation of the platform about the bracket is loosened to permit the seat portions to pivot about second end of the bracket. The seat portions may now extend outwardly toward the chamber door opening with the seat portions facing the door opening to assist a patient to be placed upon the seat. The seat portions may now be pivoted upon the seat-mounting platform to allow a patient to face into the chamber. The seat support bracket may now be pivoted upon the base to center the patient within the chamber; the seat portions and support bracket may be then secured in place.

In yet another variant of the invention, the means for locking and unlocking the chamber door includes at least one means for pivotally mounting the retaining bar. The retaining bar is so mounted to provide clearance for the ring of malleable sealing material, the first carrier and the first door guide when moving the chamber door from the second, open position to the first, closed position.

In yet a further variant of the invention, at least one means for engaging the wedge-shaped portion of the locking shaft so as to retain the door in the second position is provided. In still a further variant, a doorstop formed of resilient material is provided. The doorstop serves to limit the motion of the door when moving from the second position to the first, closed position.

In still another variant, the means for positioning the door within the chamber in a first position such that the outer surface of the door abuts the sealing material and in a second position permitting entry into the chamber further includes a means for pivotally mounting the second end of the first upper carrier rail to the ceiling of the chamber. Means for adjusting the height of the first and second upper carrier rails above the chamber floor are provided. A means for providing sliding support for the first end of the first upper carrier rail is provided. The means permits the first carrier rail to move toward and away from the chamber door opening.

A first relief notch is provided. The relief notch is located at the first end of the first section of the L-shaped lower floor track and extends at a right angle to the first section toward the chamber door opening. A second relief notch is provided. This relief notch is located at the second end of the first section of the L-shaped lower floor track and extends from the first end of the second section of the L-shaped track at a right angle to the first section toward the chamber door opening in line with the second track section.

When the door is positioned in the first, closed position and the locking shaft is moved to the second, extended position, thereby causing the wedge-shaped portion to engage the retaining bar, the door may move toward the door opening to seal against the opening.

In still a further variant, the means for positioning the door within the chamber in a first position such that the sealing material abuts the inner surface of the chamber and in a second position permitting entry into the chamber further includes a means for pivotally mounting the second end of the first upper carrier rail to the ceiling of the chamber. Means for adjusting the height of the first and second upper carrier rails above the chamber floor are provided. A means for providing sliding support for the first end of the first upper carrier rail is provided. The means permits the first carrier rail to move toward and away from the chamber door opening.

A first relief notch is provided. The relief notch is located at the first end of the first section of the L-shaped lower floor track and extends at a right angle to the first section toward the chamber door opening. A second relief notch is provided. This relief notch is located at the second end of the first section of the L-shaped lower floor track and extends from the first end of the second section of the L-shaped track at a right angle to the first section toward the chamber door opening in line with the second track section.

When the door is positioned in the first, closed position and the locking shaft is moved to the second, extended position, thereby causing the wedge-shaped portion to engage the retaining bar, the door may move toward the door opening to seal against the opening.

In a final variant of the invention, the seat pivoting system in combination with a hyperbaric chamber further includes a control member. The control member has a first end and a second end and is rotatably mounted at its first end to the first end of the seat support bracket. The control member is rotatably mounted at its second end to the seat-mounting platform. When the seat support bracket is rotated about the base the seat-mounting platform will rotate so as to maintain the orientation of the lower seat portion and seat back portion to the chamber door opening.

DETAILED DESCRIPTION OF THE PREFERRED EMBODIMENT

Figure 1:
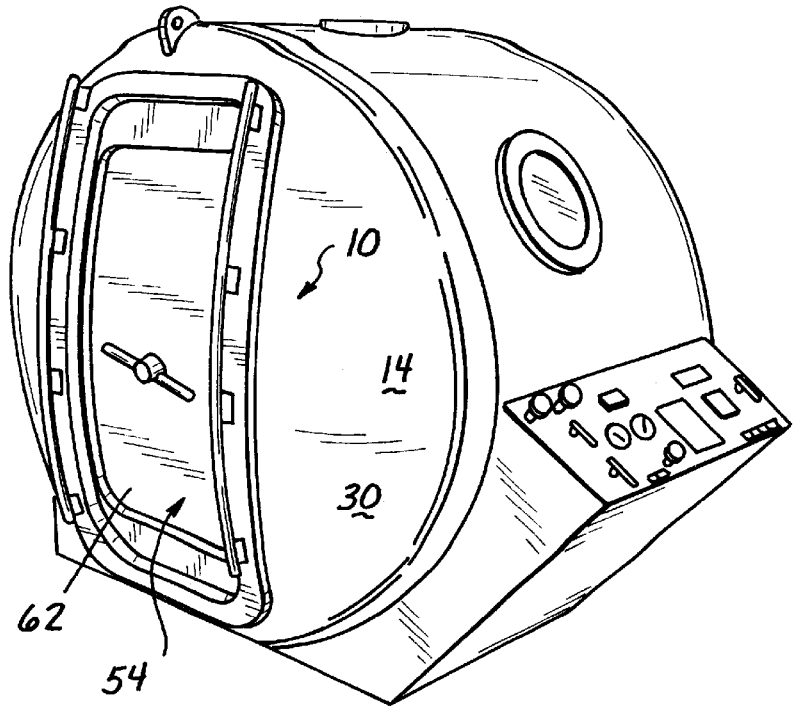
FIG. 1 is a perspective view of the preferred embodiment of the closure mechanism of the invention in the closed position.

FIGS. 1–5 illustrate a closure mechanism 10 in combination with a hyperbaric chamber 14 providing the desired features. A 14 floor 18, a ceiling a surrounding wall sealably joined to said floor and said ceiling 22, an inner surface 26, an outer surface 30 and a door opening 34 having first predetermined dimensions. As illustrated in FIGS. 2, 3*a*, 3*b* and 3*c*, a ring of malleable sealing material 42 is provided. As illustrated in FIG. 3*c*, the sealing material 42 is located on the inner surface 26 of the chamber 14 at a first predetermined distance 46 from the door opening 34. A means 50 is provided for affixing the sealing material 42 to the inner surface 26 of the chamber 14.

Figure 5:
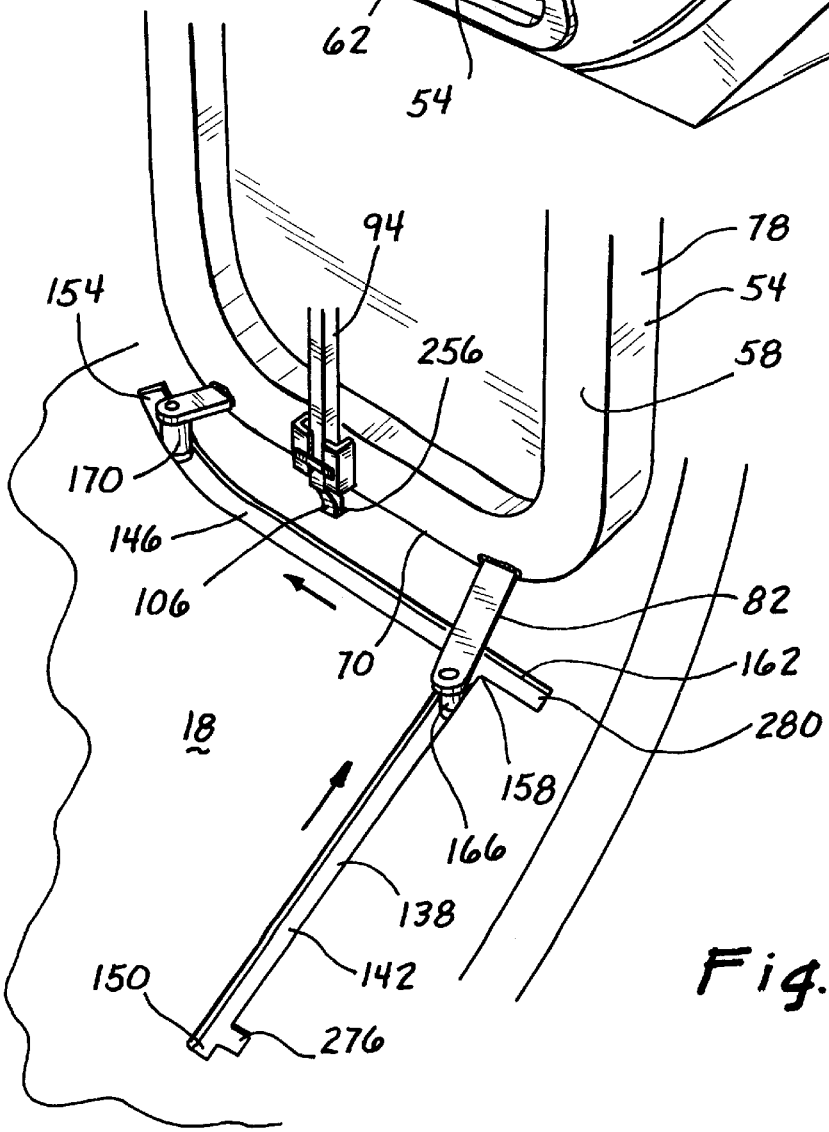
FIG. 5 is a perspective view of the FIG. 1 embodiment taken from the interior of the chamber and illustrating the lower means for positioning the door within the chamber.
Figure 3A:
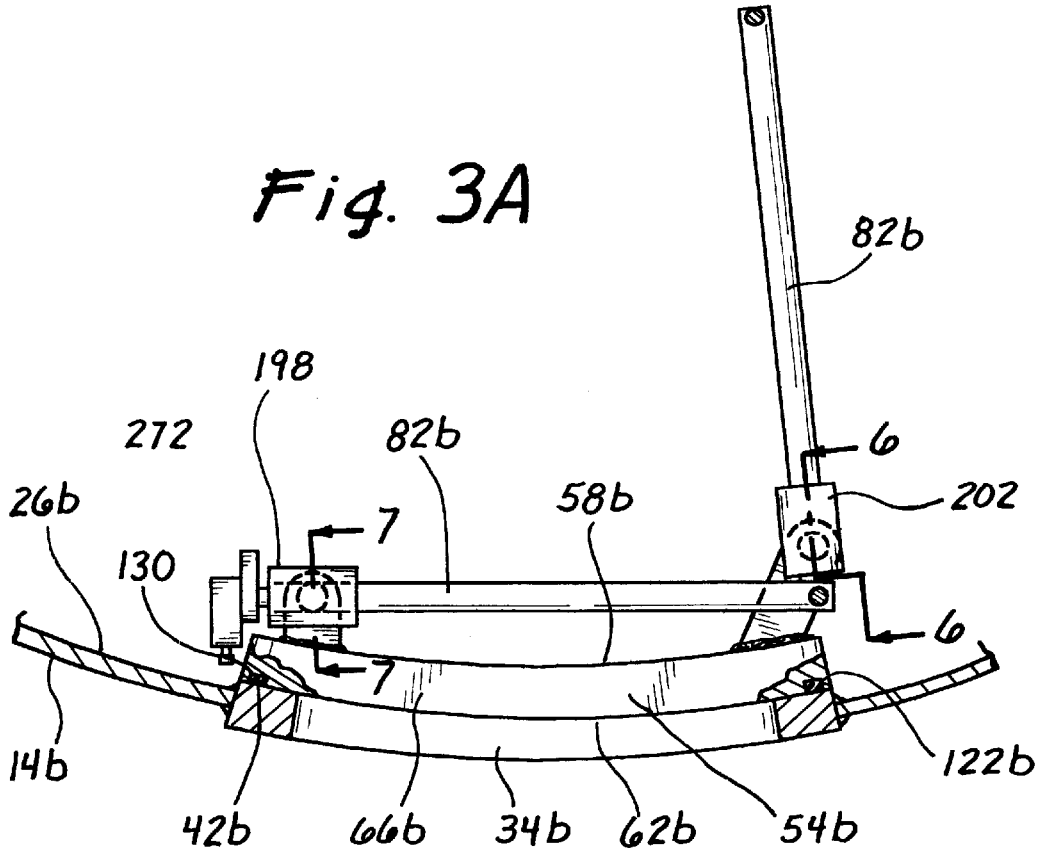
FIG. 3*a* is a plan view of the FIG. 2*a* embodiment illustrating the attachment of the seal to the outer surface of the chamber door and the door in a closed position.
Figure 3B:
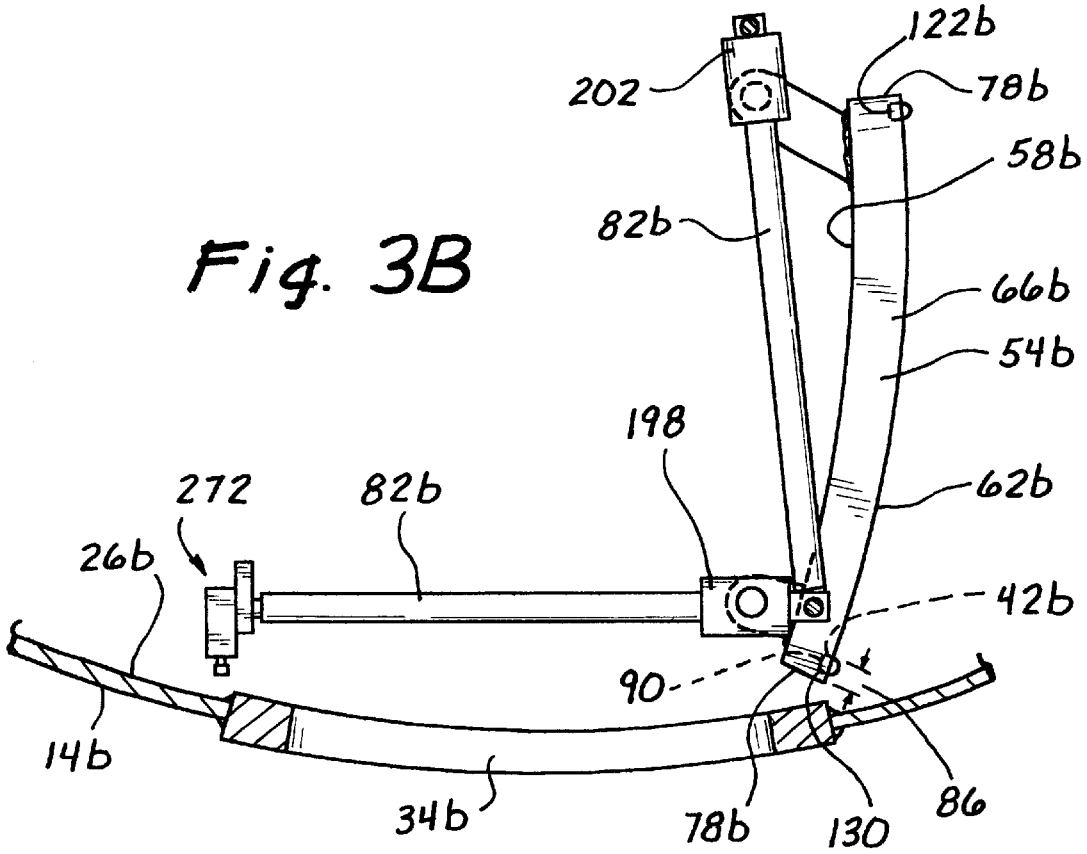
FIG. 3*b* is a plan view of the FIG. 2*a* embodiment illustrating the attachment of the seal to the outer surface of the chamber door and the door in an open position.
Figure 4:
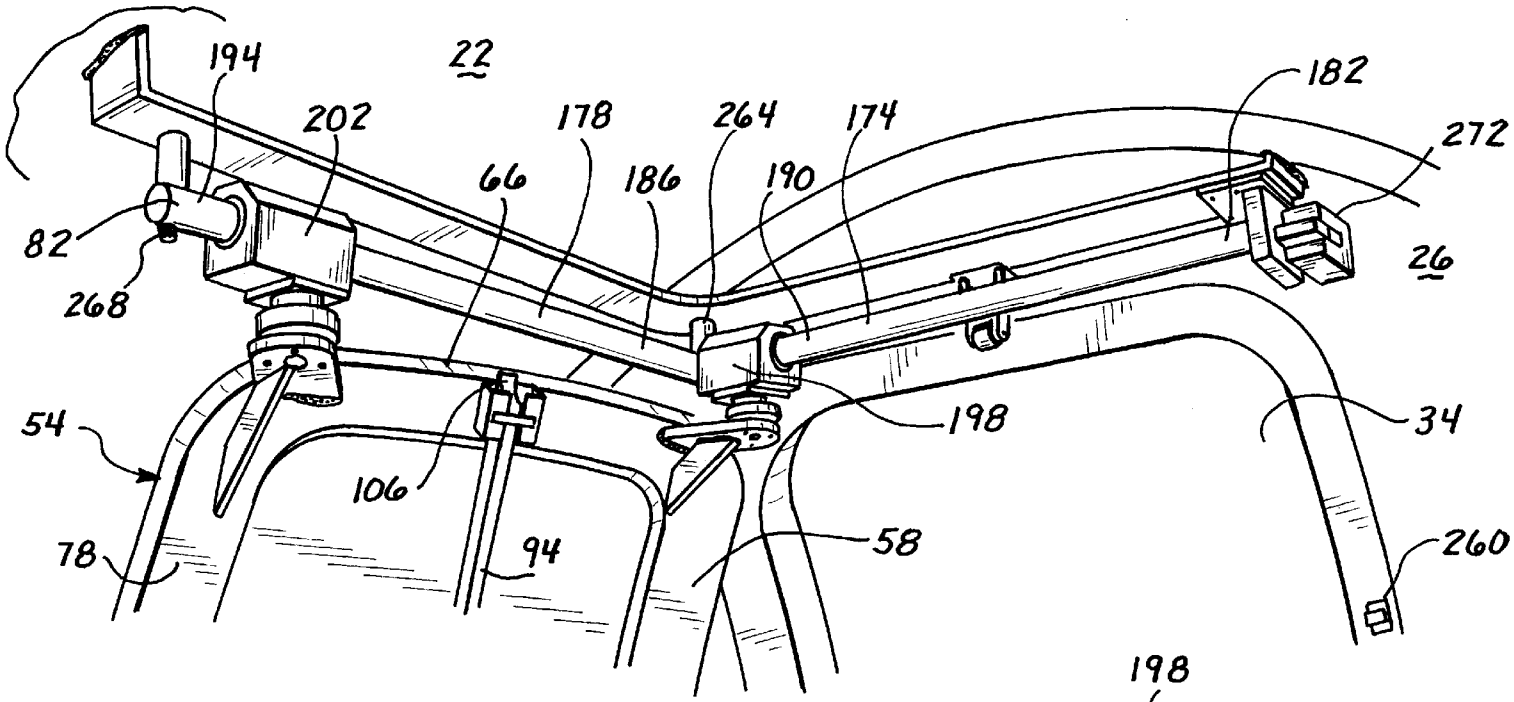
FIG. 4 is a perspective view of the FIG. 1 embodiment taken from the interior of the chamber and illustrating the upper means for positioning the door within the chamber.
Figure 3C:
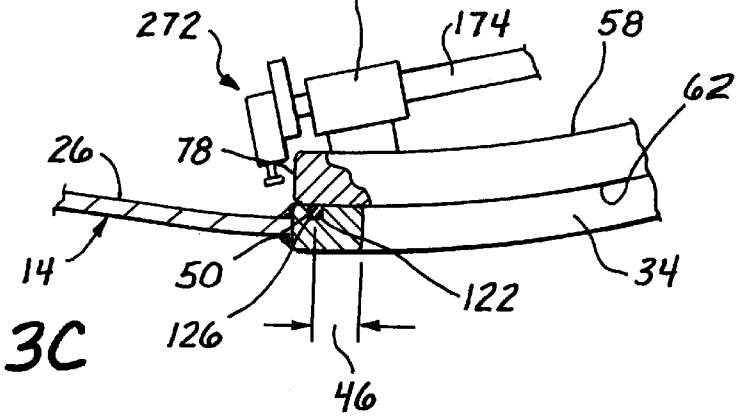
FIG. 3*c* is a plan view of the FIG. 1 embodiment illustrating the attachment of the seal to the inner surface of the chamber and the door in a closed position.

As illustrated in FIGS. 3*c*, 4, and 5, a hyperbaric chamber door 54 is provided. The door 54 has an inner surface 58, an outer surface 62, an upper end 66 and a lower end 70. The door 54 has second predetermined dimensions that are larger than the first dimensions such that the perimeter 78 of the door 54 extends beyond the ring of the sealing material 42. Means 82 are provided for positioning the door 54 within the chamber 14 in a first position such that the outer surface 62 of the door 54 abuts the sealing material 42 and in a second position permitting entry into the chamber 14. Means (not shown) are provided for pressurizing the chamber 14.

When the door 54 is located in the first position and the chamber 14 is pressurized, the door 54 will be urged against the sealing material 42. This action will seal the outer surface 62 of the chamber door 54 to the inner surface 26 of the chamber 14 and permit the pressure within the chamber 14 to be increased above ambient.

In a variant of the invention, also illustrated by FIG. 1, the door opening 34 of the hyperbaric chamber 14 is curved in at least one plane and the chamber door 54 is curved in at least one plane such that the door 54 may be sealed in position adjacent the door opening 34.

In another variant, as illustrated in FIGS. 3*a* and 3*b*, the hyperbaric chamber door 54*b* has an inner surface 58*b*, an outer surface 62*b*, an upper end 66*b* and a lower end 70*b* and has second predetermined dimensions. The second dimensions are larger than the first dimensions such that the perimeter 78*b* of the door 54*b* extends beyond the chamber door opening 34*b*.

A ring of malleable sealing material 42*b* is provided. The sealing material 42*b* is located on the outer surface 62*b* of the chamber door 54*b* at a second predetermined distance 86 from the door perimeter 78*b*. A means 90 is provided for affixing the sealing material 42*b* to the outer surface 62*b* of the door 54*b*. Means 82*b* are provided for positioning the door 54*b* within the chamber 14*b* in a first position such that the sealing material 42*b* abuts the inner surface 26*b* of the chamber 14*b* and in a second position permitting entry into the chamber 14*b*. Means (not shown) are provided for pressurizing the chamber 14*b*.

When the door 54*b* is located in the first position and the chamber 14*b* is pressurized, the door 54*b* and the affixed sealing material 42*b* will be urged against the inner surface 26*b* of the chamber 14*b*. This action will seal the outer surface 62*b* of the chamber door 54*b* to the inner surface 26*b* of the chamber 14*b* and permit the pressure within the chamber 14*b* to be increased above ambient.

Figure 2:
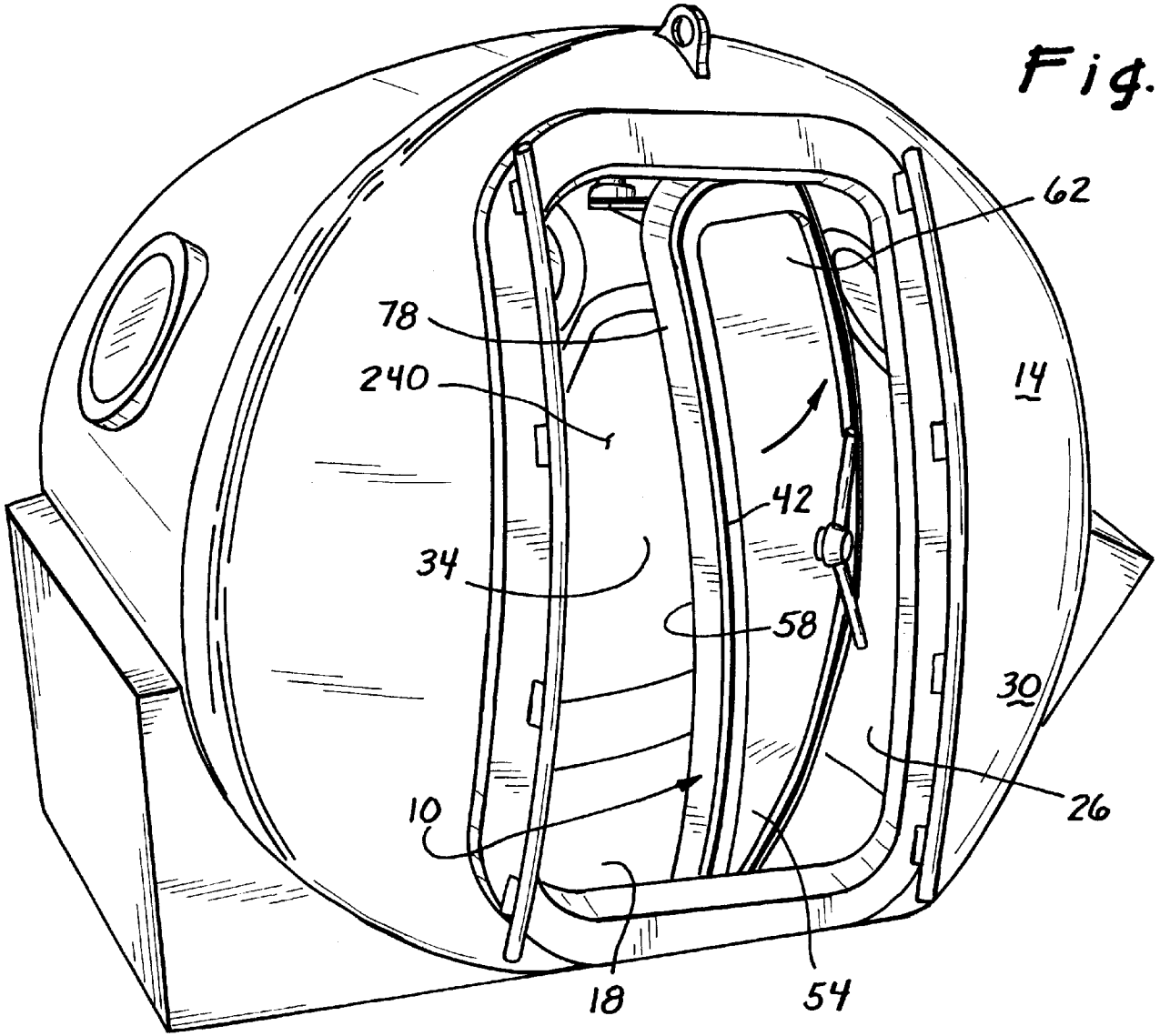
FIG. 2 is a perspective view of the FIG. 1 embodiment of the closure mechanism in the open position.
Figure 2A:
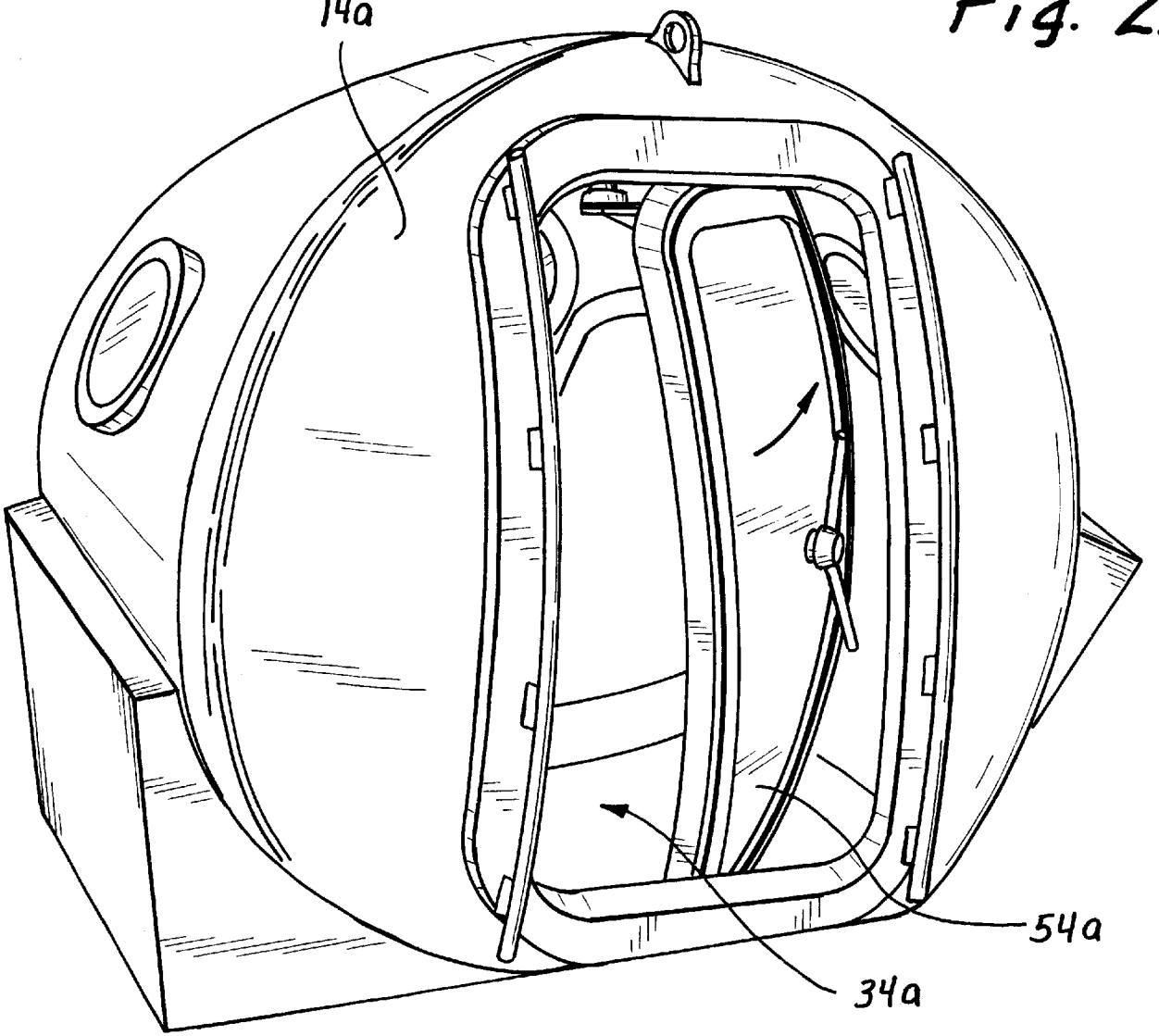
FIG. 2*a* is a perspective view of a second embodiment of the closure mechanism attached to a hyperbaric chamber in the open position illustrating a curved chamber door and door opening.

In a variant on this embodiment, as illustrated in FIG. 2*a*, the door opening 34*a* of the hyperbaric chamber 14*a* is curved in at least one plane and the chamber door 54*a* is curved in at least one plane such that the door 54*a* may be sealably positioned adjacent the door opening 34*a*.

Figure 9:
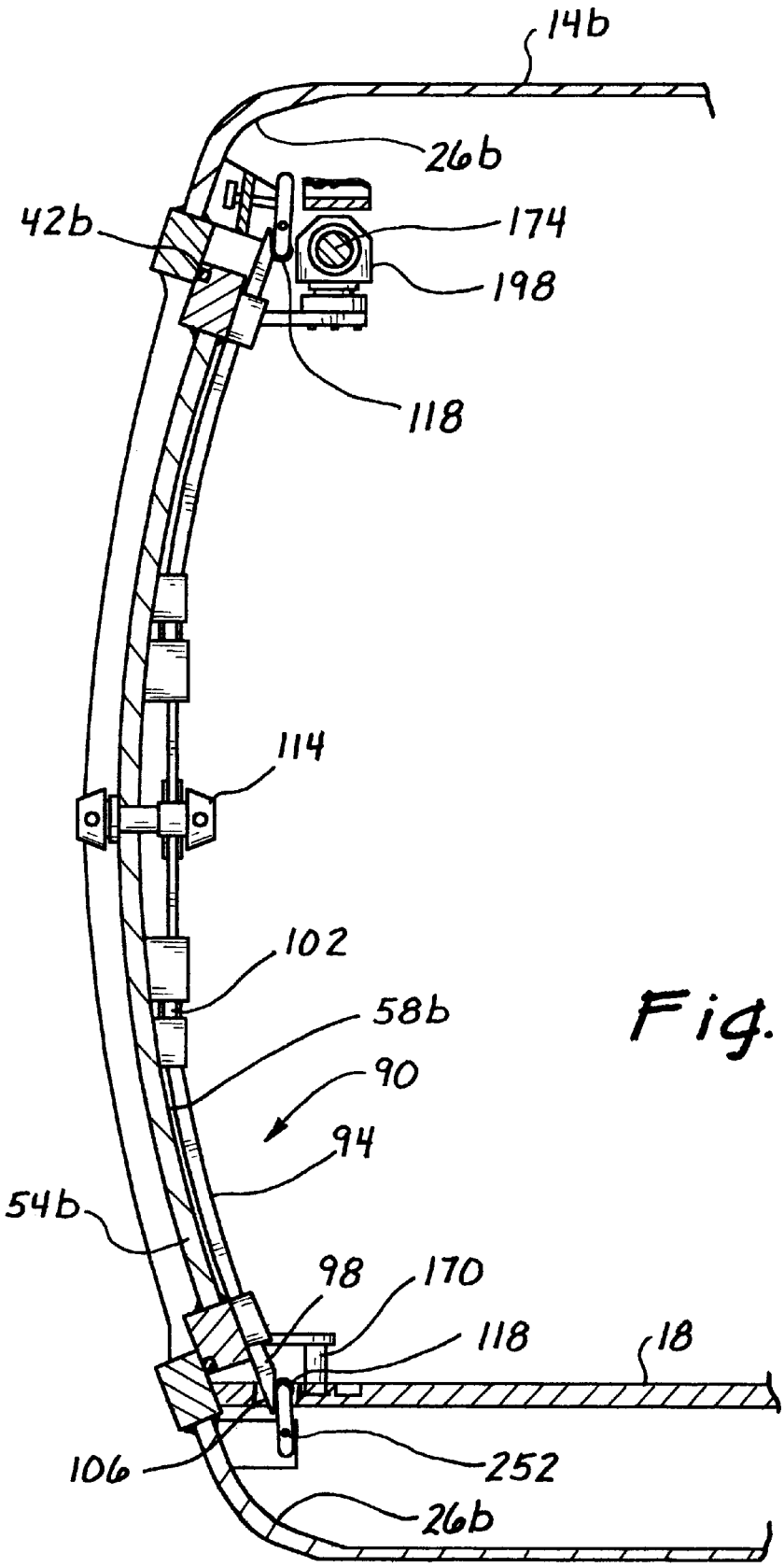
FIG. 9 is a side elevational view of the means for locking and unlocking the chamber door.
Figure 10:
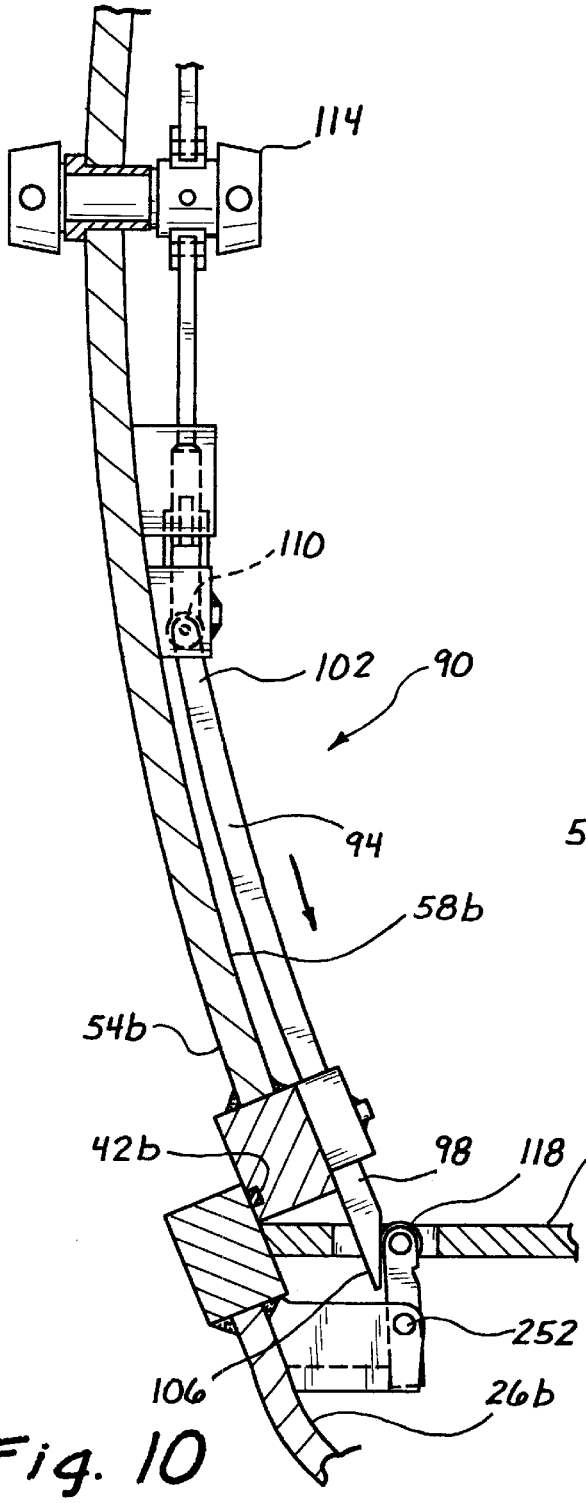
FIG. 10 is a partial enlarged side elevational view of the means for locking and unlocking the chamber door illustrating the locked position.
Figure 11:
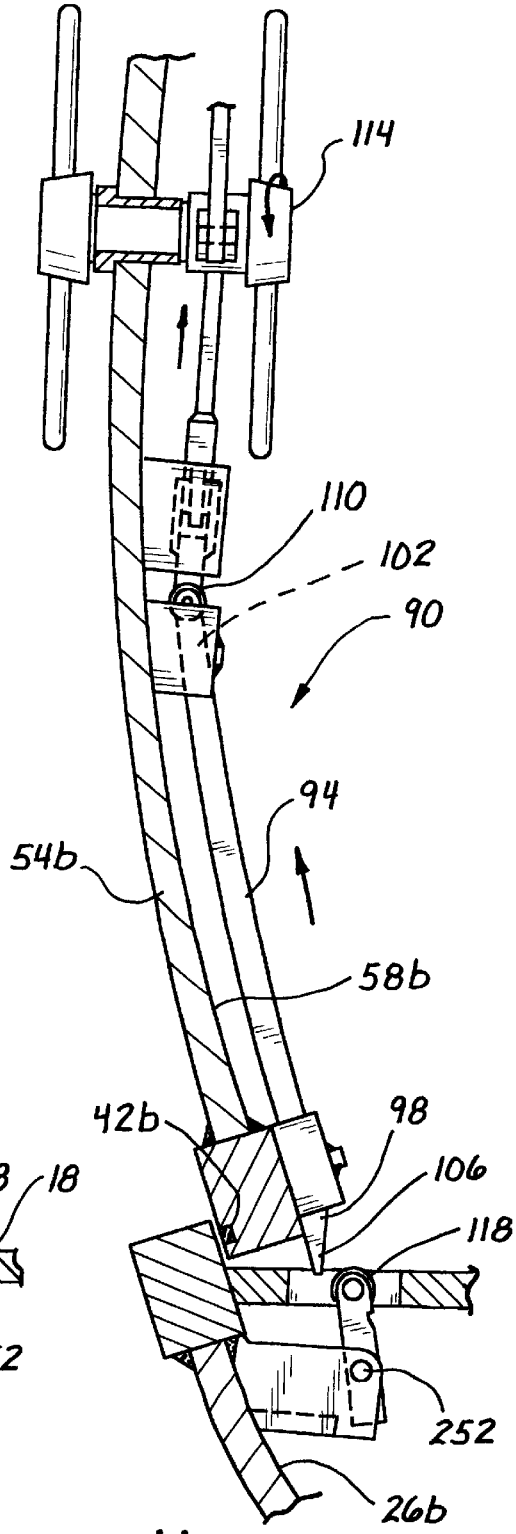
FIG. 11 is a partial enlarged side elevational view of the means for locking and unlocking the chamber door illustrating the unlocked position.

In yet another variant of the invention, as illustrated in FIGS. 9, 10 and 11, means 90 for locking and unlocking the chamber door 54*b* are provided that include the following components. At least one locking shaft 94 is provided. The shaft 94 has a first end 98, a second end 102, a wedge-shaped portion 106 located at the first end 98 and a connecting means 110 located adjacent the second end 102. The locking shaft 94 is slidably mounted to the inner surface 58*b* of the chamber door 54*b*. Means 114 attached to the connecting means 110 of the locking shaft 94 for moving the locking shaft 94 from a first, retracted position to a second extended position are provided. A retaining bar 118 is provided. The retaining bar 118 is mounted to the inner surface 26*b* of the chamber 14*b*. The retaining bar 118 is located so as to engage the wedge-shaped portion 106 of the locking shaft 94 when the shaft 94 is in the second, extended position (FIGS. 9 and 10) and located so as to be disengaged from the wedge-shaped portion 106 when the shaft 94 is in the first, retracted position (FIG. 11).

When the chamber door 54*b* is moved to the first position adjacent the door opening 34*b* and the locking shaft 94 is moved is moved from the first position to the second position, the wedge-shaped portion 106 will bear against the retaining bar 118. This action urges the door 54*b* against the inner surface 26*b* of the chamber 14*b* and compresses the ring of sealing material 42*b* to form an airtight seal between the door 54*b* and the chamber 14*b*.

When the pressure is reduced in the chamber 14*b* and the locking shaft 94 is moved from the second position to the first position, this action disengages the wedge-shaped portion 106 from the retaining bar 118. The chamber door 54*b* may now be moved to the second position to permit entry and exit from the chamber 14*b*.

In still another variant, as illustrated in FIG. 3*c*, the means 50 for affixing the sealing material 42 to the inner surface 26 of the chamber 14 includes a groove 122. The groove 122 is sized and shaped to accept a first, inner portion 126 of the ring of malleable sealing material 42 and located on the inner surface 26 of the hyperbaric chamber 14 at the first predetermined distance 46 from the door opening 34. Means (not shown) for attaching the ring of malleable sealing material 42 to the groove 122 are provided.

In yet another variant of the invention, as illustrated in FIGS. 3*a* and 3*b*, the means 90 for affixing the sealing material 42*b* to the outer surface 62*b* of the chamber door 54*b* includes a groove 122*b*. The groove 122*b* is sized and shaped to accept a second, outer portion 130 of the ring of malleable sealing material 42*b* and located on the outer surface 62*b* of the chamber door 54*b* at the second predetermined distance 86 from the door perimeter 78*b*. Means (not shown) are provided for attaching the ring of malleable sealing material 42*b* to the groove 122*b*.

In still a further variant, as illustrated in FIGS. 4 and 5, the means 82 for positioning the door 54 within the chamber 14 in a first position such that the outer surface 62 of the door 54 abuts the sealing material 42, and in a second position permitting entry into the chamber 14, further includes an L-shaped lower track 138. The lower track 138 has a first section 142 and a second section 146. Each of the sections 142, 146 has a first end 150, 154 and a second end 158, 162 and is located adjacent the floor 18 of the chamber 14. The first section 142 is substantially parallel to the door opening 34 and the second section 146 extends away from the door opening 34 and into the chamber 14. First 166 and second 170 lower door guides are provided. The lower guides 166, 170 are affixed to the inner surface 58 of the chamber door 54 adjacent its lower end 70 and are sized, shaped, and located to fit slidably within the lower track 138.

First 174 and second 178 upper carrier rails are provided. Each of the rails 174, 178 has a first end 182, 186 and a second end 190, 194. The first rail 174 is fixedly attached at its first 182 and second 190 ends to the ceiling 22 of the chamber 14. The first rail 174 is substantially parallel to door opening 34 and the first section 142 of the lower track 138. The second rail 178 is fixedly attached at its first 186 and second 194 ends to the ceiling 22 of the chamber 14. The second rail 178 extends from the second end 190 of the first rail 174 away from the door opening 34 and into the chamber 14. The second rail 178 is substantially parallel to the second section 146 of the lower track 138.

A first door carrier 198 is provided. The first carrier 198 is rotatably mounted to the inner surface 58 of the chamber door 54 adjacent its upper end 66. The first carrier 198 is sized, shaped, and located to move slidably along the first rail 174. A second door carrier 202 is provided. The second carrier 202 is rotatably mounted to the inner surface 58 of the chamber door 54 adjacent its upper end 66 and is sized, shaped, and located to move slidably along the second rail 178.

When the chamber door 54 is located in the first position, the first door guide 166 will be located adjacent the first end 150 of the first section 142 of the lower track 138 and the second door guide 170 will be located adjacent the second end 158 of the first section 142 of the lower track 138. The first door carrier 198 will be located adjacent the first end 182 of the first upper carrier rail 174 and the second door carrier 202 will be located adjacent the first end 186 of the second upper carrier rail 178. When the carriers 198, 202 and guides 166, 170 are so positioned, it allows the chamber door 54 to be sealed to the chamber 14.

When the chamber door 54 is located in the second position, the first door guide 166 will be located adjacent the second end 158 of the first section 142 of the lower track 138 and the second door guide 170 will be located adjacent the first end 154 of the second section 146 of the lower track 138. The first door carrier 198 will be located adjacent the second end 190 of the first upper carrier rail 174 and the second door carrier 202 will be located adjacent the second end 194 of the second upper carrier rail 178. When the carriers 198, 202 and guides 166, 170 are so positioned, entry into the chamber 14 is possible.

In yet a further variant of the invention, as illustrated in FIGS. 3*a* and 3*b*, the means 82*b* for positioning the door 54*b* within the chamber 14*b* in a first position such that the sealing material 42*b* abuts the inner surface 58*b* of the chamber 14*b* and in a second position permitting entry into the chamber 14*b* further includes an L-shaped lower track 138. As illustrated in FIG. 5, the lower track 138 has a first section 142 and a second section 146. Each of the sections 142, 146 has a first end 150, 154 and a second end 158, 162 and is located adjacent the floor 18 of the chamber 14. The first section 142 is substantially parallel to the door opening 34 and the second section 146 extends away from the door opening 34 and into the chamber 14.

As illustrated in FIG. 4, first 166 and second 170 lower door guides are provided. The lower guides 166, 170 are affixed to the inner surface 58 of the chamber door 54 adjacent its lower end 70 and are sized, shaped, and located to fit slidably within the lower track 138. First 174 and second 178 upper carrier rails are provided. Each of the rails 174, 178 has a first end 182, 186 and a second end 190, 194. The first rail 174 is fixedly attached at its first 182 and second 190 ends to the ceiling 22 of the chamber 14. The first rail 174 is substantially parallel to door opening 34 and the first section 142 of the lower track 138. The second rail 178 is fixedly attached at its first 186 and second 194 ends to the ceiling 22 of the chamber 14. The second rail 178 extends from the second end 190 of the first rail 174 away from the door opening 34 and into the chamber 14. The second rail 178 is substantially parallel to the second section 146 of the lower track 138.

Figure 6:
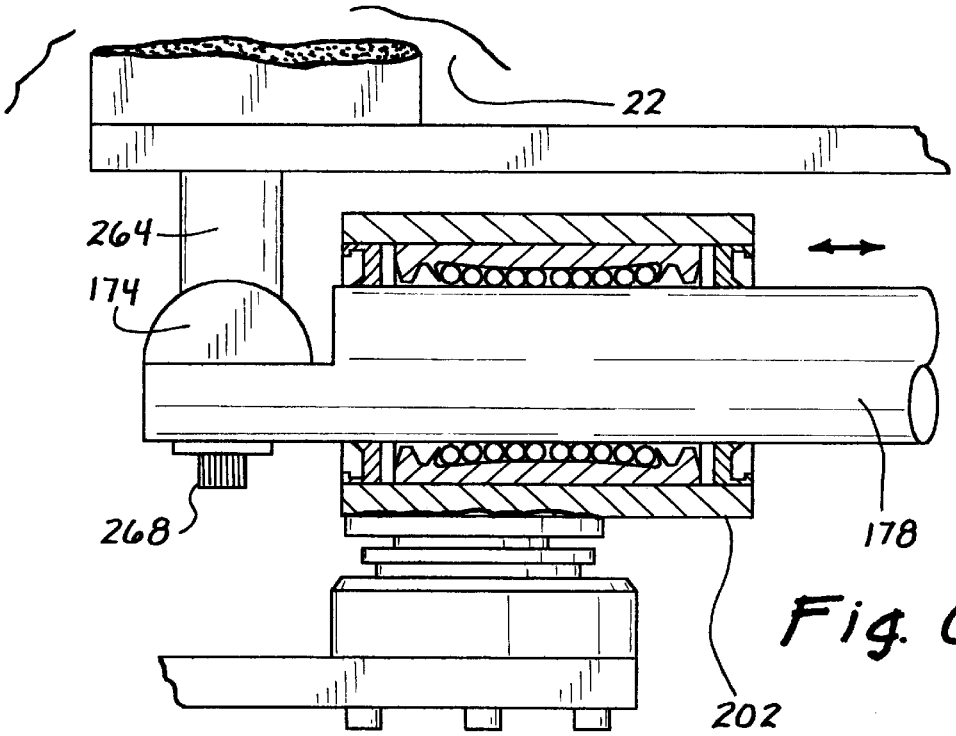
FIG. 6 is a partial cross-sectional side elevation of the first door carrier and first upper carrier rail.
Figure 7:
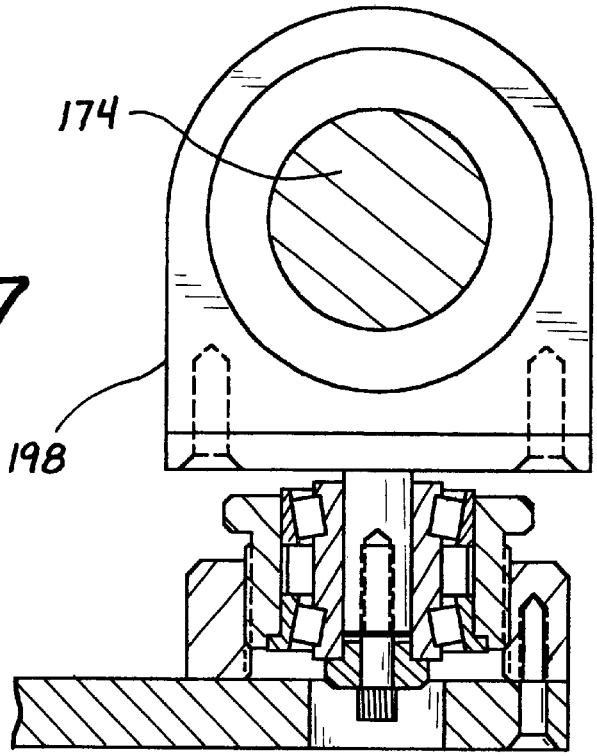
FIG. 7 is a cross-sectional end view of the first upper carrier rail and a partial cross-sectional end view of the first door carrier.

As further illustrated in FIGS. 6 and 7, a first door carrier 198 is provided. The first carrier 198 is rotatably mounted to the inner surface 58 of the chamber door 54 adjacent its upper end 66. The first carrier 198 is sized, shaped, and located to move slidably along the first rail 174. A second door carrier 202 is provided. The second carrier 202 is rotatably mounted to the inner surface 58 of the chamber door 54 adjacent its upper end 66 and is sized, shaped, and located to move slidably along the second rail 178.

When the chamber door 54 is located in the first position, the first door guide 166 will be located adjacent the first end 150 of the first section 142 of the lower track 138 and the second door guide 170 will be located adjacent the second end 158 of the first section 142 of the lower track 138. The first door carrier 198 will be located adjacent the first end 182 of the first upper carrier rail 174 and the second door carrier 202 will be located adjacent the first end 186 of the second upper carrier rail 178. When the carriers 198, 202 and guides 166, 170 are so positioned, it allows the chamber door 54 to be sealed to the chamber 14.

When the chamber door 54 is located in the second position, the first door guide 166 will be located adjacent the second end 158 of the first section 142 of the lower track 138 and the second door guide 170 will be located adjacent the first end 154 of the second section 146 of the lower track 138. The first door carrier 198 will be located adjacent the second end 190 of the first upper carrier rail 174 and the second door carrier 202 will be located adjacent the second end 194 of the second upper carrier rail 178. When the carriers 198, 202 and guides 166, 170 are so positioned, entry into the chamber 14 is possible.

Figure 12:
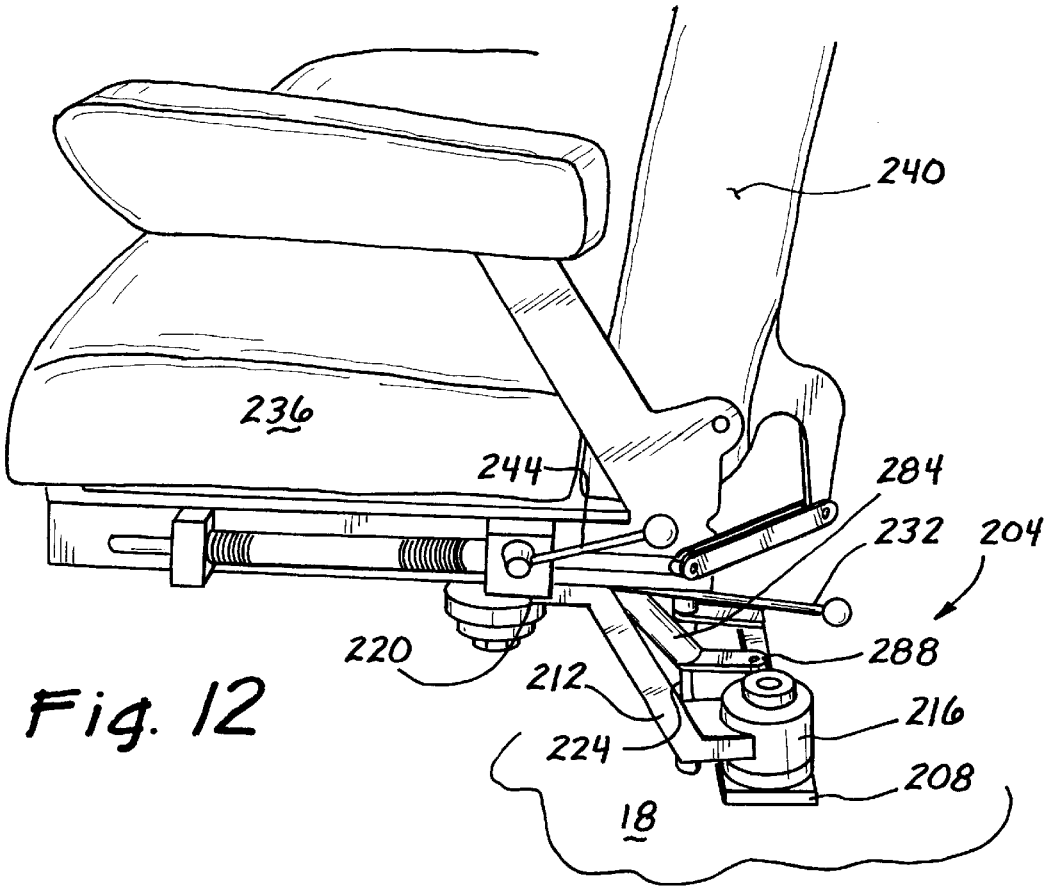
FIG. 12 is a perspective view of the seat pivoting system and seat portions in combination with the hyperbaric chamber.
Figure 13:
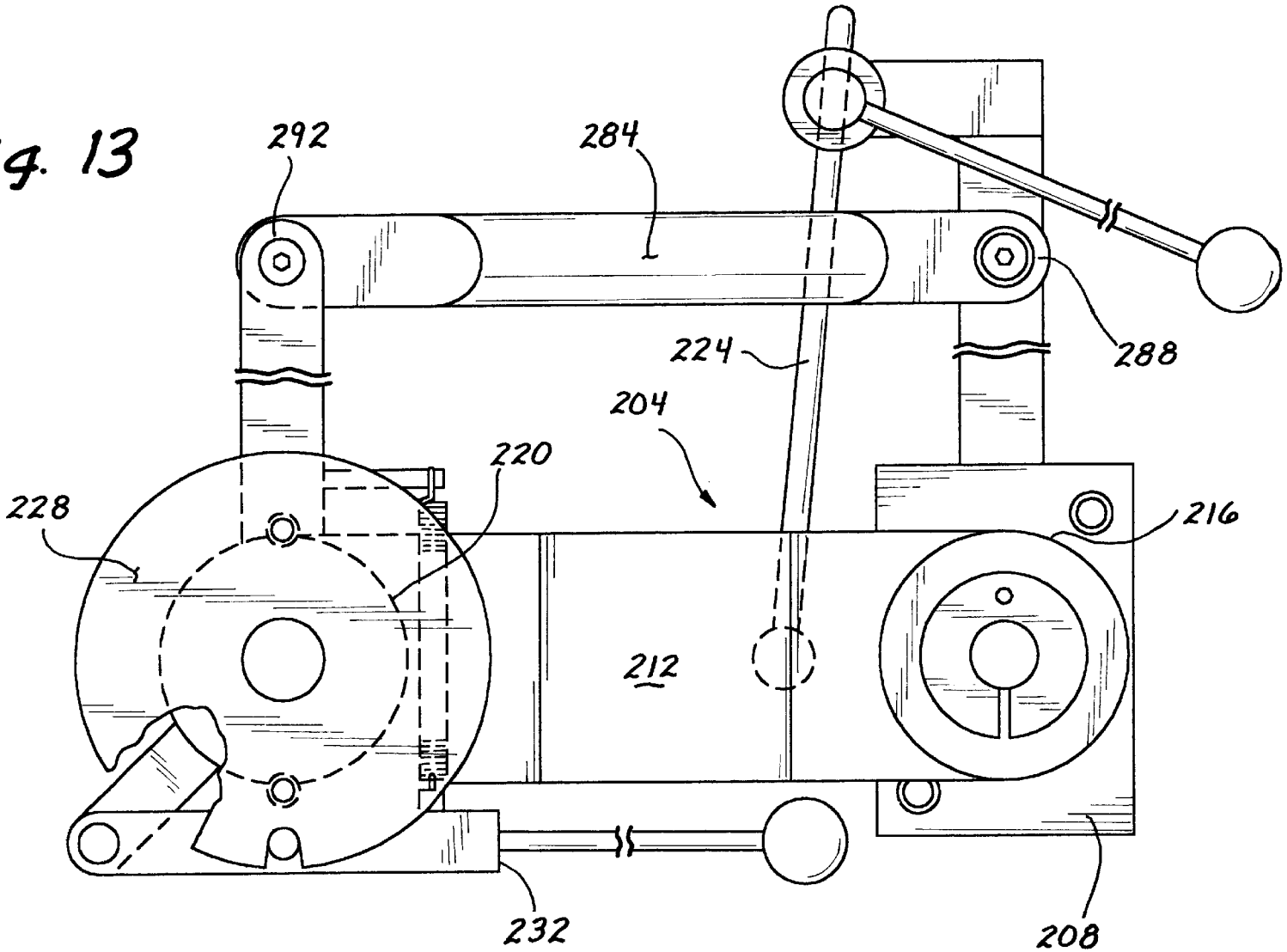
FIG. 13 is a plan view of the seat pivoting in combination with the hyperbaric chamber.

In another variant of the invention, as illustrated in FIGS. 2, 12 and 13, a seat pivoting system 204 in combination with a hyperbaric chamber includes the following components. A 14 is provided. The chamber has a floor 18, a ceiling (not shown), a surrounding wall sealably an joined to said floor and said ceiling inner surface 26, an outer surface 30 and a door opening 34 having first predetermined dimensions. A base 208 is provided that is fixedly attached to the chamber floor 18 adjacent the door opening 34.

A seat support bracket 212 is provided. The bracket 212 has a first end 216 and a second end 220 and is rotatably mounted at the first end 216 to the base 208. Means 224 are provided for controlling the rotation of the bracket 212 about the base 208. A seat-mounting platform 228 is provided. The platform 228 is rotatably mounted to the second end 216 of the bracket 212. Means 232 are provided for controlling the rotation of the platform 228 about the bracket 212. A lower seat portion 236 is fixedly attached to the seat-mounting platform 228. A seat back portion 240 is pivotally mounted to the lower seat portion 236. Means 244 are provided for adjusting the inclination of the seat back portion 240 with respect to the lower seat portion 236.

In use, the means 224 for controlling the rotation of the bracket 212 about the base 208 is loosened so that the bracket 212 may pivot about the base 208. The means 232 for controlling the rotation of the platform 228 about the bracket 212 is loosened to permit the seat portions 236, 240 to pivot about second end 220 of the bracket 212. The seat portions 236, 240 may now extend outwardly toward the chamber door opening 34 with the seat portions 236, 240 facing the door opening 34 to assist a patient to be placed upon the seat. The seat portions 236, 240 may now be pivoted upon the seat-mounting platform 228 to allow a patient 248 to face into the chamber 14. The seat support bracket 212 may now be pivoted upon the base 208 to center the patient 248 within the chamber 14, the seat portions 236, 240 and support bracket 212 may be then secured in place.

In yet another variant of the invention, as illustrated in FIGS. 9, 10 and 11, the means 90 for locking and unlocking the chamber door 54*b* includes at least one means 252 for pivotally mounting the retaining bar 118. The retaining bar 118 is so mounted to provide clearance for the ring of malleable sealing material 42*b*, the first carrier 198 and the first door guide 166 when moving the chamber door 54*b* from the second, open position to the first, closed position.

In yet a further variant of the invention, as illustrated in FIG. 5, at least one means 256 for engaging the wedge-shaped portion 106 of the locking shaft 94 so as to retain the door 54 in the second position, is provided. In still a further variant, as illustrated in FIG. 4, a doorstop 260 formed of resilient material is provided. The doorstop 260 serves to limit the motion of the door 54 when moving from the second position to the first, closed position.

In still another variant, as illustrated in FIGS. 4 and 6, the means for positioning the door 54 within the chamber 14 in a first position such that the outer surface 62 of the door 54 abuts the sealing material 42 and in a second position permitting entry into the chamber 14 further includes a means 264 for pivotally mounting the second end 190 of the first upper carrier rail 174 to the ceiling 22 of the chamber 14. Means 268 for adjusting the height of the first 174 and second 178 upper carrier rails above the chamber floor 18 are provided. A means 272 for providing sliding support for the first end 182 of the first upper carrier rail 174 is provided. The means 272 permits the first carrier rail 174 to move toward and away from the chamber door opening 34.

As illustrated in FIG. 5, a first relief notch 276 is provided. The relief notch 276 is located at the first end 150 of the first section 142 of the L-shaped lower floor track 138 and extends at a right angle to the first section 142 toward the chamber door opening 34. A second relief notch 280 is provided. This relief notch 280 is located at the second end 158 of the first section 142 of the L-shaped lower floor track 138 and extends from the first end 154 of the second section 146 of the L-shaped track 138 at a right angle to the first section 142 toward the chamber door opening 34 in line with the second track section 146.

When the door 54 is positioned in the first, closed position and the locking shaft 94 is moved to the second, extended position, thereby causing the wedge-shaped portion 106 to engage the retaining bar 118, the door 54 may move toward the door opening 34 to seal against the opening 34.

Figure 8:
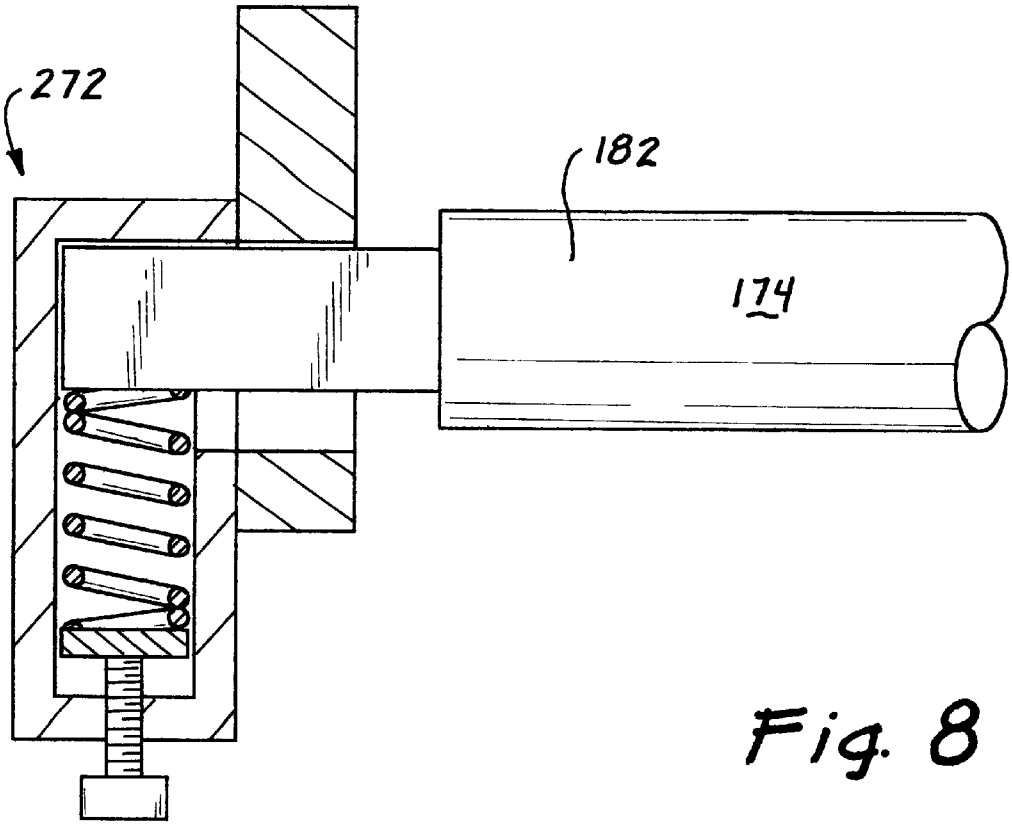
FIG. 8 is a cross-sectional side elevation of the means for providing sliding support for the first end of the upper carrier rail.

In still a further variant, as illustrated in FIGS. 3*a* and 3*b*, the means for positioning the door 54*b* within the chamber 14*b* in a first position such that the sealing material 42*b* abuts the inner surface 26*b* of the chamber 14*b* and in a second position permitting entry into the chamber 14*b*, as illustrated in FIG. 4, further includes a means 264 for pivotally mounting the second end 190 of the first upper carrier rail 174 to the ceiling 22 of the chamber 14. Means 268 for adjusting the height of the first 174 and second 178 upper carrier rails above the chamber floor 18 are provided. A means 272, as illustrated in FIGS. 4 and 8, for providing sliding support for the first end 182 of the first upper carrier rail 174 is provided. The means 272 permits the first carrier rail 174 to move toward and away from the chamber door opening 34.

As illustrated in FIG. 5, a first relief notch 276 is provided. The relief notch 276 is located at the first end 150 of the first section 142 of the L-shaped lower floor track 138 and extends at a right angle to the first section toward the chamber door opening 34. A second relief notch 280 is provided. This relief notch 280 is located at the second end 158 of the first section 142 of the L-shaped lower floor track 138 and extends from the first end 154 of the second section 146 of the L-shaped track 138 at a right angle to the first section 142 toward the chamber door opening 34 in line with the second track section 146.

When the door 54 is positioned in the first, closed position and the locking shaft 94 is moved to the second, extended position, thereby causing the wedge-shaped portion 106 to engage the retaining bar 118, the door 54 may move toward the door opening 34 to seal against the opening 34.

In a final variant of the invention, as illustrated in FIGS. 12 and 13, the seat pivoting system 204 in combination with a hyperbaric chamber 14 further includes a control member 284. The control member 284 has a first end 288 and a second end 292 and is rotatably mounted at its first end 288 adjacent the first end 216 of the seat support bracket 212. The control member 284 is rotatably mounted at its second end 292 adjacent the seat mounting platform 228. When the seat support bracket 212 is rotated about the base 208 the seat-mounting platform 228 will rotate so as to maintain the orientation of the lower seat portion 236 and seat back portion 240 to the chamber door opening 34.

The door system 10 and seat pivoting system 204 in combination with a hyperbaric chamber have been described with reference to particular embodiments. Other modifications and enhancements can be made without departing from the spirit and scope of the claims that follow.

What is claimed is:

1. A hyperbaric chamber, comprising:

a floor, a ceiling, a surrounding wall sealably joined to said floor and said ceiling, an inner surface, an outer surface and a door opening having first predetermined dimensions;

a ring of malleable sealing material, said sealing material disposed upon the inner surface of the chamber at a first predetermined distance from the door opening;

means for affixing said sealing material to the inner surface of the chamber;

a hyperbaric chamber door, said door having an inner surface, an outer surface, an upper end and a lower end and having second predetermined dimensions, said second dimensions being larger than said first dimensions such that the perimeter of the door extends beyond the ring of the sealing material;

means for positioning said door within the chamber in a first position such that the outer surface of the door abuts the sealing material, permitting the outer surface of the hyperbaric chamber door to seal against the door opening, and in a second position permitting entry into the chamber;

said door opening, against which the hyperbaric chamber door seals being non-planar; said outer surface of said hyperbaric chamber door, which seals against said door opening being non-planar;

means for pressurizing the chamber;

means for locking and unlocking the chamber door comprising at least one locking shaft, said shaft having a first end, a second end, a wedge-shaped portion disposed at said first end and a connecting means disposed adjacent the second end;

said locking shaft being slidably mounted to the inner surface of the chamber door;

means attached to the connecting means of the locking shaft for moving said locking shaft from a first, retracted position to a second extended position;

at least one retaining bar, said bar fixedly mounted to the inner surface of the chamber and disposed so as to engage the wedge-shaped portion of the locking shaft when the shaft is in the second, extended position and disposed so as to be disengaged from the wedge-shaped portion when the shaft is in the first, retracted position;

whereby, when the chamber door is moved to the first position adjacent the door opening and the locking shaft is moved from the first position to the second position, the wedge-shaped portion will bear against the retaining bar, thereby urging the door against the inner surface of the chamber and compressing the ring of sealing material to form an air-tight seal between the door and the chamber; and whereby, when the pressure is reduced in the chamber and the locking shaft is moved from the second position to the first position, thereby disengaging the wedge-shaped portion from the retaining bar, the chamber door may be moved to the second position to permit entry and exit from the chamber.

2. A hyperbaric chamber as described in claim 1 wherein the means for affixing said sealing material to the inner surface of the chamber further comprises:

a groove, said groove being sized and shaped to accept a first, inner portion of the ring of malleable sealing material and disposed upon the inner surface of the hyperbaric chamber at the first predetermined distance from the door opening; and means for attaching the ring of malleable sealing material to the groove.

3. A hyperbaric chamber as described in claim 1 wherein the means for positioning said door within the chamber in a first position such that the outer surface of the door abuts the sealing material and in a second position permitting entry into the chamber further comprises:

an L-shaped lower track, said lower track having a first section and a second section, each of said sections having a first end and a second end and being disposed adjacent the floor of the chamber with the first section substantially parallel to the door opening and the second section extending away from the door opening and into the chamber;

first and second lower door guides, said lower guides being affixed to the inner surface of the chamber door adjacent its lower end and being sized, shaped, and disposed to fit slidably within the lower track;

first and second upper carrier rails, each of said rails having a first end and a second end, said first rail being fixedly attached at its first and second ends to the ceiling of the chamber substantially parallel to door opening and the first section of the lower track, said second rail being fixedly attached at its first and second ends to the ceiling of the chamber and extending from the second end of the first rail away from the door opening and into the chamber, said second rail being substantially parallel to the second section of the lower track;

a first door carrier, said first carrier being rotatably mounted to the inner surface of the chamber door adjacent its upper end and being sized, shaped, and disposed to move slidably along the first rail;

a second door carrier, said second carrier being rotatably mounted to the inner surface of the chamber door adjacent its upper end and being sized, shaped, and disposed to move slidably along the second rail;

whereby, when the chamber door is disposed in the first position, the first door guide will be disposed adjacent the first end of the first section of the lower track, the second door guide will be disposed adjacent the second end of the first section of the lower track, the first door carrier will be disposed adjacent the first end of the first upper carrier rail, and the second door carrier will be disposed adjacent the first end of the second upper carrier rail, thereby allowing the chamber door to be sealed to the chamber; and whereby, when the chamber door is disposed in the second position, the first door guide will be disposed adjacent the second end of the first section of the lower track, the second door guide will be disposed adjacent the first end of the second section of the lower track, the first door carrier will be disposed adjacent the second end of the first upper carrier rail, and the second door carrier will be disposed adjacent the second end of the second upper carrier rail, thereby permitting entry into the chamber.

4. A hyperbaric chamber as described in claim 3 wherein the means for positioning said door within the chamber in a first position such that the outer surface of the door abuts the sealing material and in a second position permitting entry into the chamber further comprises:

a means for pivotally mounting the second end of the first upper carrier rail to the ceiling of the chamber;

means for adjusting the height of the first and second upper carrier rails above the chamber floor;

a means for providing sliding support for the first end of the first upper carrier rail, said means permitting the carrier rail to move toward and away from the chamber door opening;

a first relief notch, said relief notch disposed at the first end of the first section of the L-shaped lower floor track and extending orthogonally toward the chamber door opening;

a second relief notch, said relief notch disposed at the second end of the first section of the L-shaped lower floor track and extending from the first end of the second section of the L-shaped track orthogonally toward the chamber door opening collinear with the second track section; and whereby, when the door is positioned in the first, closed position and the locking shaft is moved to the second, extended position, thereby causing the wedge-shaped portion to engage the retaining bar, the door may move toward the door opening to seal against said opening.

5. A hyperbaric chamber as described in claim 1 wherein the means for locking and unlocking the chamber door further comprises:

at least one means for pivotally mounting the retaining bar so as to provide clearance for the ring of malleable sealing material, the first carrier and the first door guide when moving the chamber door from the second, open position to the first, closed position;

at least one means for engaging the wedge-shaped portion of the locking shaft so as to retain the door in the second position; and a doorstop, said doorstop being formed of resilient material and serving to limit the motion of the door when moving from the second position to the first, closed position.

6. A hyperbaric chamber, comprising:

a floor, a ceiling, a surrounding wall sealably joined to said floor and said ceiling, an inner surface, an outer surface and a door opening having first predetermined dimensions;

a hyperbaric chamber door, said door having an inner surface, an outer surface, an upper end and a lower end and having second predetermined dimensions, said second dimensions being larger than said first dimensions such that the perimeter of the door extends beyond the chamber door opening;

a ring of malleable sealing material, said sealing material disposed upon the outer surface of the chamber door at a second predetermined distance from the door perimeter;

means for affixing said sealing material to the outer surface of the door;

means for positioning said door within the chamber in a first position such that the sealing material abuts the inner surface of the chamber, permitting the outer surface of the hyperbaric chamber door to seal against the door opening, and in a second position permitting entry into the chamber;

said door opening, against which the hyperbaric chamber door seals being non-planar;

said outer surface of said hyperbaric chamber door, which seals against said door opening being non-planar;

means for pressurizing the chamber;

means for locking or unlocking the chamber door comprising at least one locking shaft, said shaft having a first end, a second end, a wedge-shaped portion disposed at said first end and a connecting means disposed adjacent the second end;

said locking shaft being slidably mounted to the inner surface of the chamber door;

means attached to the connecting means of the locking shaft for moving said locking shaft from a first, retracted position to a second extended position;

at least one retaining bar, said bar fixedly mounted to the inner surface of the chamber and disposed so as to engage the wedge-shaped portion of the locking shaft when the shaft is in the second, extended position and disposed so as to be disengaged from the wedge-shaped portion when the shaft is in the first, retracted position;

whereby, when the chamber door is moved to the first position adjacent the door opening and the locking shaft is moved is moved from the first position to the second position, the wedge-shaped portion will bear against the retaining bar, thereby urging the door against the inner surface of the chamber and compressing the ring of sealing material to form an air-tight seal between the door and the chamber; and whereby, when the pressure is reduced in the chamber and the locking shaft is moved from the second position to the first position, thereby disengaging the wedge-shaped portion from the retaining bar, the chamber door may be moved to the second position to permit entry and exit from the chamber.

7. A hyperbaric chamber as described in claim 6 wherein the means for affixing said sealing material to the outer surface of the chamber door further comprises:

a groove, said groove being sized and shaped to accept a second, outer portion of the ring of malleable sealing material and disposed upon the outer surface of the chamber door at the second predetermined distance from the door perimeter; and means for attaching the ring of malleable sealing material to the groove.

8. A hyperbaric chamber as described in claim 6 wherein the means for positioning said door within the chamber in a first position such that the sealing material abuts the inner surface of the chamber and in a second position permitting entry into the chamber further comprises:

an L-shaped lower track, said lower track having a first section and a second section, each of said sections having a first end and a second end and being disposed adjacent the floor of the chamber with the first section substantially parallel to the door opening and the second section extending away from the door opening and into the chamber;

first and second lower door guides, said lower guides being affixed to the inner surface of the chamber door adjacent its lower end and being sized, shaped, and disposed to fit slidably within the lower track;

first and second upper carrier rails, each of said rails having a first end and a second end, said first rail being fixedly attached at its first and second ends to the ceiling of the chamber substantially parallel to door opening and the first section of the lower track, said second rail being fixedly attached at its first and second ends to the ceiling of the chamber and extending from the second end of the first rail away from the door opening and into the chamber, said second rail being substantially parallel to the second section of the lower track;

a first door carrier, said first carrier being rotatably mounted to the inner surface of the chamber door adjacent its upper end and being sized, shaped, and disposed to move slidably along the first rail;

a second door carrier, said second carrier being rotatably mounted to the inner surface of the chamber door adjacent its upper end and being sized, shaped, and disposed to move slidably along the second rail;

whereby, when the chamber door is disposed in the first position, the first door guide will be disposed adjacent the first end of the first section of the lower track, the second door guide will be disposed adjacent the second end of the first section of the lower track, the first door carrier will be disposed adjacent the first end of the first upper carrier rail, and the second door carrier will be disposed adjacent the first end of the second upper carrier rail, thereby allowing the chamber door to be sealed to the chamber; and whereby, when the chamber door is disposed in the second position, the first door guide will be disposed adjacent the second end of the first section of the lower track, the second door guide will be disposed adjacent the first end of the second section of the lower track, the first door carrier will be disposed adjacent the second end of the first upper carrier rail, and the second door carrier will be disposed adjacent the second end of the second upper carrier rail, thereby permitting entry into the chamber.

9. A hyperbaric chamber as described in claim 8 wherein the means for positioning said door within the chamber in a first position such that the sealing material abuts the inner surface of the chamber and in a second position permitting entry into the chamber further comprises:

a means for pivotally mounting the second end of the first upper carrier rail to the ceiling of the chamber;

means for adjusting the height of the first and second upper carrier rails above the chamber floor;

a means for providing sliding support for the first end of the first upper carrier rail, said means permitting the carrier rail to move toward and away from the chamber door opening;

a first relief notch, said relief notch disposed at the first end of the first section of the L-shaped lower floor track and extending orthogonally toward the chamber door opening;

a second relief notch, said relief notch disposed at the second end of the first section of the L-shaped lower floor track and extending from the first end of the second section of the L-shaped track orthogonally toward the chamber door opening collinear with the second track section; and whereby, when the door is positioned in the first, closed position and the locking shaft is moved to the second, extended position, thereby causing the wedge-shaped portion to engage the retaining bar, the door may move toward the door opening to seal against said opening.

10. A hyperbaric chamber as described in claim 6 wherein the means for locking and unlocking the chamber door further comprises:

at least one means for pivotally mounting the retaining bar so as to provide clearance for the ring of malleable sealing material, the first carrier and the first door guide when moving the chamber door from the second, open position to the first, closed position;

at least one means for engaging the wedge-shaped portion of the locking shaft so as to retain the door in the second position; and a doorstop, said doorstop being formed of resilient material and serving to limit the motion of the door when moving from the second position to the first, closed position.

11. A hyperbaric chamber, comprising:

a floor, a ceiling, a surrounding wall sealably joined to said floor and said ceiling, an inner surface, an outer surface and a door opening having first predetermined dimensions;

a base, said base being fixedly attached to the chamber floor adjacent the door opening;

a seat support bracket, said bracket having a first end and a second end and being rotatably mounted at said first end to said base;

means for controlling the rotation of said bracket about said base;

a seat-mounting platform, said platform being rotatably mounted to the second end of said bracket;

means for controlling the rotation of said platform about said bracket;

a lower seat portion, said lower portion being fixedly attached to said seat-mounting platform;

a seat back portion, said seat back being pivotally mounted to said lower seat portion;

means for adjusting the inclination of said seat back with respect to said lower seat portion; and whereby, when the means for controlling the rotation of the bracket about the base is loosened so that the bracket may pivot about the base, and when the means for controlling the rotation of the platform about the bracket is loosened so that the seat may pivot about second end of the bracket, the seat portions may extend outwardly toward the chamber door opening with the seat portions facing the door opening to assist a patient to be placed upon the seat, thereafter the seat portions may be pivoted upon the seat mounting platform to allow a patient to face into the chamber and the seat support bracket may be pivoted upon the base to center the patient within the chamber, the seat portions and support bracket may be then secured in place.

12. A hyperbaric chamber as described in claim 11, further comprising:

a control member, said control member having a first end and a second end and being rotatably mounted at its first end to the first end of the seat support bracket and being rotatably mounted at its second end to the seat mounting platform; and whereby, when the seat support bracket is rotated about the base the seat-mounting platform will rotate so as to maintain the orientation of the lower seat portion and seat back portion to the chamber door opening.

* * * * *